US005525423A

United States Patent [19]

Liberman et al.

[11] Patent Number: 5,525,423

[45] Date of Patent: Jun. 11, 1996

[54] METHOD OF MAKING MULTIPLE DIAMETER METALLIC TOW MATERIAL

[75] Inventors: Michael Liberman; Alexander Sobolevsky, both of DeLand, Fla.

[73] Assignee: Memtec America Corporation, Timonium, Md.

[21] Appl. No.: 254,543

[22] Filed: Jun. 6, 1994

[51] Int. Cl.[6] ..... D02G 3/00

[52] U.S. Cl. ..... 428/370; 428/375; 428/397; 428/401; 428/288; 428/600; 428/605; 428/606; 428/607; 57/210

[58] Field of Search ..... 428/370, 375, 428/397, 399, 401, 288, 600, 605, 606, 607; 57/210

[56] References Cited

U.S. PATENT DOCUMENTS

| | | | |
|---|---|---|---|
| 1,934,643 | 11/1933 | Rafton . | |
| 2,050,298 | 8/1936 | Everett . | |
| 2,215,477 | 9/1940 | Pipkin . | |
| 2,616,165 | 11/1952 | Brennan . | |
| 3,127,668 | 4/1964 | Troy . | |
| 3,161,478 | 12/1964 | Chessin . | |
| 3,262,815 | 7/1966 | Langer et al. . | |
| 3,277,564 | 10/1966 | Webber et al. . | |
| 3,310,387 | 3/1967 | Sump et al. . | |
| 3,341,446 | 9/1967 | Vielstich et al. . | |
| 3,378,999 | 4/1968 | Roberts et al. . | |
| 3,379,000 | 4/1968 | Webber et al. | 57/243 |
| 3,503,200 | 3/1970 | Roberts et al. . | |
| 3,540,114 | 11/1970 | Roberts et al. . | |
| 3,657,014 | 4/1972 | Faber | 136/64 |
| 3,694,325 | 9/1972 | Katz et al. . | |
| 3,698,863 | 10/1972 | Roberts et al. | 428/600 |
| 3,740,834 | 6/1973 | Douglass | 29/570 |
| 3,905,831 | 9/1975 | Brown et al. | 136/86 D |
| 3,973,059 | 8/1976 | Brown et al. | 427/180 |
| 3,977,070 | 8/1976 | Schildbach | 29/243 |
| 4,044,447 | 8/1977 | Hamada et al. | 29/419 R |
| 4,115,528 | 9/1978 | Christner et al. | 423/449 |
| 4,118,845 | 10/1978 | Schildbach | 29/33 X |
| 4,206,271 | 6/1980 | Norling et al. | 429/45 |
| 4,251,603 | 2/1981 | Matsumoto et al. | 429/94 |
| 4,265,703 | 5/1981 | Terliska | 162/146 |
| 4,340,631 | 7/1982 | Endo et al. | 428/399 |
| 4,371,742 | 2/1983 | Manly | 174/36 |

(List continued on next page.)

FOREIGN PATENT DOCUMENTS

| | | | |
|---|---|---|---|
| 0074263 | 3/1983 | European Pat. Off. . | |
| 821690 | 10/1959 | United Kingdom | 428/605 |
| 942513 | 11/1963 | United Kingdom | 428/605 |

OTHER PUBLICATIONS

Fiber Metallurgy, Metcalf et al., "Metal Progress," Mar. 1955, pp. 81–84.

Fiber Metals: A New Adventure in Engineering Materials "The Iron Age", Jan. 24, 1963, pp. 53–55.

Carbon Blacks as Cathode Materials For Rechargeable Lithium Cells, J. Electrochem. Soc: Electro–Chemical Science and Technology, Jun., 1987, pp. 1318–1321.

*Primary Examiner*—N. Edwards

*Attorney, Agent, or Firm*—Frijouf Rust & Pyle

[57] ABSTRACT

An apparatus and method is disclosed for an improved fiber tow having plural diameter metallic wires, comprising the drawing of a first cladded metallic wire to provide a first drawn cladding of reduced diameter. The first cladding is separated into a primary portion and a secondary portion with the secondary portion being drawn to reduce further the diameter. A selected mixture of the primary and the secondary portions are cladded to provide a secondary cladding. A plurality of the second drawn claddings is cladded and drawn to provide a third cladding of reduced diameter. The third cladding is drawn and the claddings are removed to provide a fiber tow comprising metallic wires having a major diameter and a minor diameter. The fiber tow may be severed into uniform length to provide slivers of metallic wires having plural diameters. The plural diameter slivers may be used for various purposes including a filter medium or may be encapsulated within polymeric material for providing an electrically conductive metallic layer therein.

4 Claims, 5 Drawing Sheets

U.S. PATENT DOCUMENTS

| | | | |
|---|---|---|---|
| 4,394,244 | 7/1983 | Divisek et al. | 204/295 |
| 4,399,853 | 8/1983 | Morimoto et al. | 428/399 |
| 4,408,255 | 10/1983 | Adkins | 361/382 |
| 4,435,252 | 3/1984 | Kadija | 204/11 |
| 4,448,856 | 5/1984 | Zuckerbrod et al. | 429/27 |
| 4,456,521 | 6/1984 | Solomon et al. | 204/292 |
| 4,471,015 | 9/1984 | Ebneth et al. | 428/195 |
| 4,500,647 | 2/1985 | Solomon | 502/101 |
| 4,506,028 | 3/1985 | Fukuda et al. | 502/101 |
| 4,518,705 | 5/1985 | Solomon et al. | 502/101 |
| 4,574,108 | 3/1986 | Fakirov et al. | 428/399 |
| 4,597,028 | 6/1986 | Yoshida et al. | 361/305 |
| 4,628,593 | 12/1986 | Fritts et al. | 29/623.1 |
| 4,643,940 | 2/1987 | Shaw et al. | 428/308.4 |
| 4,664,971 | 5/1987 | Soens | 428/288 |
| 4,670,214 | 6/1987 | Magnuson et al. | 419/3 |
| 4,737,889 | 4/1988 | Nishino et al. | 361/433 |
| 4,743,349 | 5/1988 | Bachot et al. | 204/242 |
| 4,785,136 | 11/1988 | Mollet et al. | 174/35 R |
| 4,818,631 | 4/1989 | Bourgois | 428/377 |
| 4,874,677 | 10/1989 | Reiche et al. | 428/605 |
| 4,885,120 | 12/1989 | McQuillan et al. | 264/60 |
| 4,925,539 | 5/1990 | Francois | 204/146 |
| 4,940,524 | 7/1990 | Perineau et al. | 204/242 |
| 4,944,991 | 7/1990 | Karas et al. | 428/408 |
| 4,969,497 | 11/1990 | Bourgois | 428/377 |
| 4,980,232 | 12/1990 | Prevorsk et al. | 428/401 |
| 4,990,490 | 2/1991 | Pathare et al. | 505/1 |
| 5,011,638 | 4/1991 | Pinkhasov | 264/59 |
| 5,028,490 | 7/1991 | Koskennaki et al. | 428/594 |
| 5,071,713 | 12/1991 | Francois | 428/606 |
| 5,076,898 | 12/1991 | Nidola et al. | 204/128 |
| 5,080,963 | 1/1992 | Tatarchuk et al. | 428/225 |
| 5,102,745 | 4/1992 | Tatarchuk et al. | 428/605 |
| 5,106,707 | 4/1992 | Catotti et al. | 429/94 |
| 5,137,782 | 8/1992 | Adriansen et al. | 428/370 |
| 5,153,057 | 10/1992 | Corbett et al. | 428/283 |
| 5,158,828 | 10/1992 | Sudani et al. | 428/368 |
| 5,165,985 | 11/1992 | Wiste et al. | 428/209 |
| 5,188,892 | 2/1993 | Grindstaff | 428/370 |
| 5,200,281 | 4/1993 | Leap et al. | 429/129 |
| 5,200,282 | 4/1993 | Ohnishi et al. | 429/223 |
| 5,225,489 | 7/1993 | Prevorsek et al. | 428/401 |
| 5,226,210 | 7/1993 | Koskenmaki et al. | 29/527.5 |
| 5,244,758 | 9/1993 | Bronoel et al. | 429/223 |
| 5,264,284 | 11/1993 | Miyata | 428/401 |
| 5,304,300 | 4/1994 | Tatarchuk et al. | 264/61 |

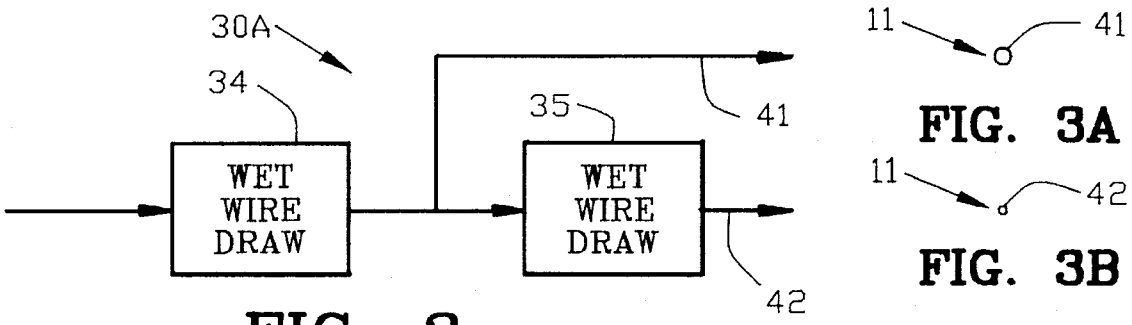
FIG. 3
FIG. 3A
FIG. 3B
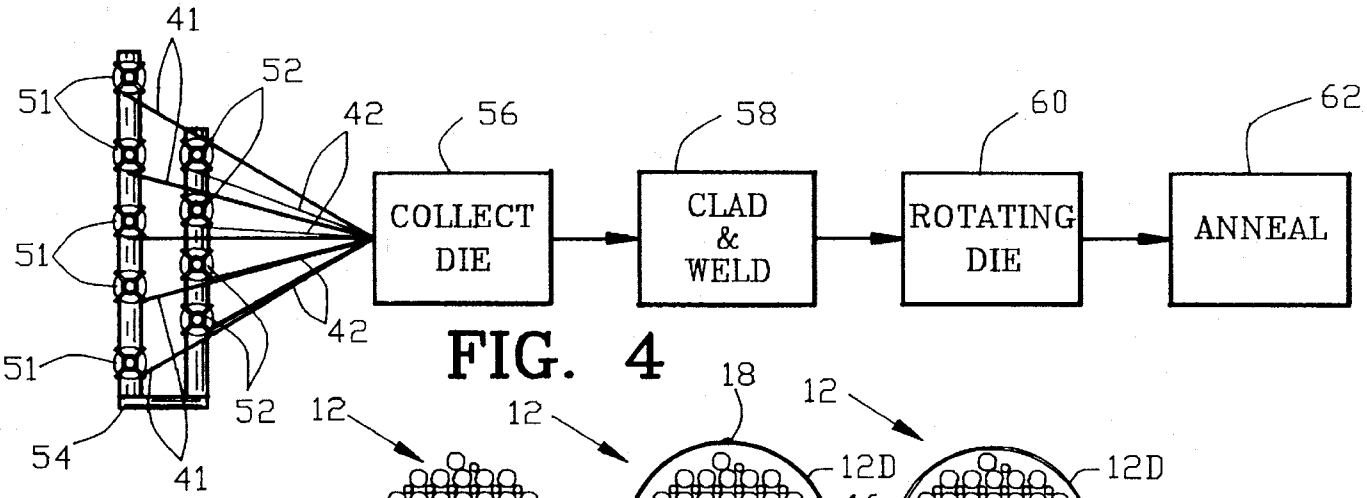
FIG. 4
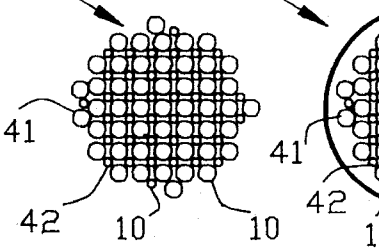
FIG. 4A
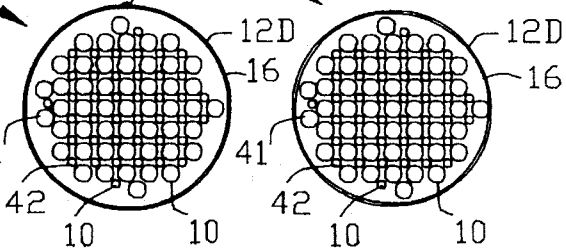
FIG. 4B
FIG. 4C

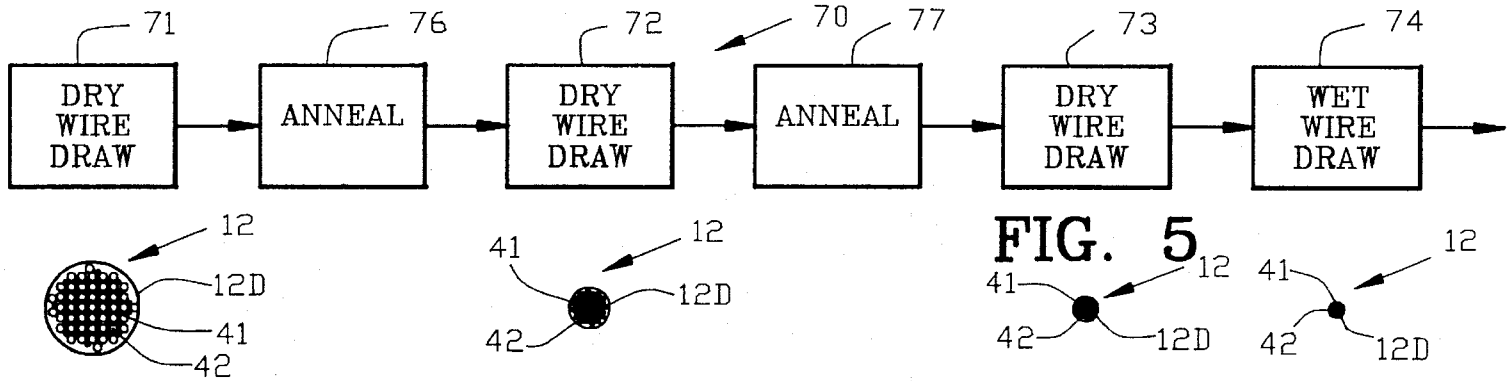
FIG. 5A
FIG. 5B
FIG. 5C
FIG. 5D
FIG. 5
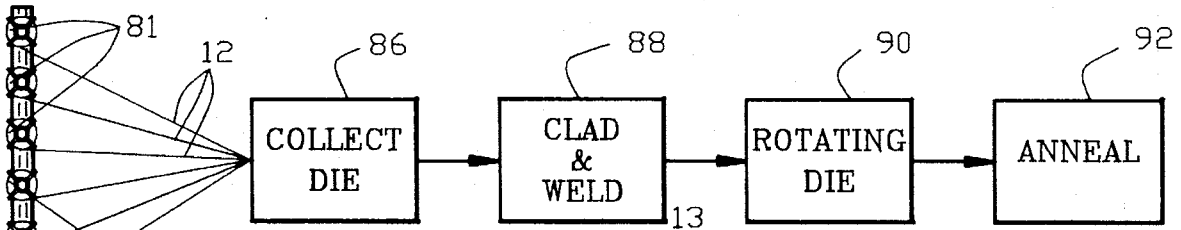
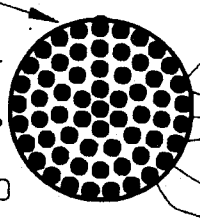
FIG. 6A
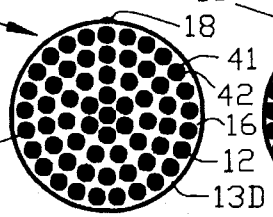
FIG. 6B
FIG. 6C
FIG. 6

DRY WIRE DRAW
101
ANNEAL
106
100
DRY WIRE DRAW
102
ANNEAL
107
DRY WIRE DRAW
103
WET WIRE DRAW
104
13
13D
12
41
10
42

TWIST
110
STRESS RELIEF
112
LEACH
114
RINSE & DRY
122
120
SEVER
124
130

11
16

METHOD OF MAKING MULTIPLE DIAMETER METALLIC TOW MATERIAL

BACKGROUND OF THE INVENTION

1. Field of the Invention

This invention relates to a metallic fiber tow and more particularly to an improved method of making a fiber tow having fibers of plural diameters. This invention relates to an improved method of making a fiber tow having a diameter previously unobtainable in the prior art on a commercial basis. This invention also relates to a composite material comprising a fiber tow having fibers of plural diameters encapsulated within a polymeric material to form a two dimensional conductive layer.

2. Background of the Invention

The problems associated with electrostatic discharge and the damaging effects to sensitive electronic components have been well known in the prior art. A static charge can be generated by friction between two surfaces resulting in a substantial potential difference created between the two surfaces. A sensitive electronic component such as an integrated circuit or a circuit board that may come into proximity or contact with one of the statically charged surfaces can be damaged or destroyed by a static discharge from one of the statically charged surfaces.

A related problem exists relating to interference generated by electronic devices especially electronic devices encased in polymeric cases. This interference is commonly referred to as electromagnetic interference (EMI) generated in the kilohertz to gigahertz frequency range. In addition, many electronic devices encased in polymeric cases must be shielded from external electromagnetic interference (EMIT).

To overcome these separate but related problems, the prior art had used a variety of composite materials comprising a polymeric substrate and a conductive metal layer. These composite materials typically have used a continuous metallic coating deposited onto the polymeric substrate for creating an electrostatic shield commonly referred to as a Faraday cage. Others in the prior art have used a discontinuous metallic coating encapsulated in a polymeric laminate. One discontinuous metallic coating of the prior art encapsulated a metallic powder within a polymeric laminate while another discontinuous metallic coating of the prior art encapsulated metallic fibers within a polymeric laminate.

U.S. Pat. No. 2,215,477 to Pipkin discloses a method of manufacturing wires of a relatively brittle metal that consists of assembling a rod of the metal within a tube of a relatively ductile metal to form therewith a composite single assembly and successively drawing the assembly through a series of dies to form a composite wire element. A plurality of the wire elements are assembled within a tube of metal of the same character as that of the first-named tube to form therewith a composite multiple assembly, successively drawing the multiple assembly through a series of dies to reduce the same to a predetermined diameter, and then removing the ductile metal from the embedded wires of brittle metal.

U.S. Pat. No. 3,378,999 to Roberts et al discloses a metal yarn structure wherein the filaments are set under pressure while in a substantially nonelastic state to be free of residual torsion while having a preselected helical twist. The setting of the filaments in the helical configuration is effected by twisting the filaments in a matrix while concurrently effecting constriction thereof to fluidize the filaments and permit the setting thereof upon release of the constriction forces in the torsion-free helical configuration.

U.S. Pat. No. 3,540,144 to Roberts et al discloses a method of forming fine filaments formed of a material such as metal by multiple end drawing a plurality of elongated elements having thereon a thin film of lubricant material. The plurality of elements may be bundled in a tubular sheath formed of drawable material. The lubricant may be applied to the individual elements prior to the bundling thereof and may be provided by applying the lubricant to the elements while they are being individually drawn through a coating mechanism such as a drawing die. The lubricant comprises a material capable of forming a film having a high tenacity characteristic whereby the film is maintained under the extreme pressure conditions of the drawing process. Upon completion of the constricting operation, the tubular sheath is removed. If desired, the lubricant may also be removed from the resultant filaments.

U.S. Pat. No. 3,698,863 to Roberts et al discloses a metallic filament that has an effective diameter of less than 50 microns and is formed while surrounded by a subsequently removed sacrificial matrix. The filament has a preselected peripheral surface varying from substantially smooth to re-entrant and a preselected surface to volume ratio. The area of the filament also has a controlled non-uniformity along the length thereof that provides an acceptable dimensional tolerance. The metallic filament may be substantially one metal, bimetallic or tubular.

U.S. Pat. No. 3,977,070 to Schildbach discloses a method of forming a tow of filaments and the tow formed by the method wherein a bundle of elongated elements, such as rods or wires, is clad by forming a sheath of material different from that of the elements about the bundle and the bundle is subsequently drawn to constrict the elements to a desired small diameter. The elements may be formed of metal. The bundle may be annealed, or stress relieved, between drawing steps as desired. The sheath may be formed of metal and may have juxtaposed edges thereof welded together to retain the assembly. The sheath is removed from the final constricted bundle to free the filaments in the form of tow.

U.S. Pat. No. 4,118,845 to Schildbach discloses a method of forming a tow of filaments and the tow formed by the method wherein a bundle of elongated elements, such as rods or wires, is clad by forming a sheath of material different from that of the elements about the bundle and the bundle is subsequently drawn to constrict the elements to a desired small diameter. The elements may be formed of metal. The bundle may be annealed, or stress relieved, between drawing steps as desired. The sheath may be formed of metal and may have juxtaposed edges thereof welded together to retain the assembly. The sheath is removed from the final constricted bundle to free the filaments in the form of tow.

U.S. Pat. No. 4,371,742 to Manly discloses an absorptive shield for transmission lines, especially those tending to radiate electromagnetic wave lengths within a frequency range of from about $10^6$ to about $10^{10}$ hertz, especially $10^7$ to about $10^{10}$ hertz. The shields are flexible materials filled with ferromagnetic, or ferrimagnetic, powders of selected particle size and distribution.

U.S. Pat. No. 4,408,255 to Adkins discloses an electromagnetic shield comprising two portions in which the first portion consists of a magnetically permeable mat with a conductive sheet bonded to one side and an insulating sheet bonded to the opposite side. In a typical application, this first portion is positioned with the insulating sheet making contact to the underside of a printed circuit board. The second portion consists of a magnetically permeable mat with a conductive sheet bonded to each side. The mat is porous and one of the conductive sheets contains a plurality of openings to permit cooling air that is forced through the pores of the mat to pass through these openings. The conductive sheet containing the plurality of openings is positioned adjacent the components on the upper side of a printed circuit board to provide cooling as well as closely positioned shielding.

U.S. Pat. No. 4,664,971 to Soens discloses a plate or sheet-like article made of plastic in which very low contents of fine electrically conductive fibers are uniformly dispersed so as to make the articles conductive. It also relates to specific intermediate plastic products, referred to as grains, threads and granules, and the processes for manufacturing each of these products as well as the final conductive articles. The articles can be used as a suitable shielding against radio-frequency and high-frequency electromagnetic radiation or as antistatic plastic articles.

U.S. Pat. No. 4,785,136 to Mollet discloses an electromagnetic interference shielding cover for computer terminals or the like comprising a layer of woven metallic or metalized synthetic conductive fabric covering the computer terminal top side, bottom side, right side, left side, front side and rear side. The embodiments described provide full electrical and magnetic continuity throughout the shielding cover and can take the form of a free standing box-like rigid cover, or a fitted flexible cover. Woven metal or metalized conductive mesh conditioned for viewing enhancement and glare reduction is provided in an individual, framed section and connected over appropriate cut-out openings to allow continuity of electromagnetic shielding and visual access. The shielding cover may consist of a single enclosure or where appropriate, multiple enclosures connected by means of an electromagnetically continuous joint allowing console articulation.

U.S. Pat. No. 5,028,490 to Koskenmaki et al discloses a discontinuous metal/polymer composite, with a metal layer, formed from a plurality of fine metal strands, which may be used, for example, in static or EMI shielding. The metal layer comprises a plurality of fine metal strands provided on the substrate, the metal strands individually having a cross-section with an area of about 100 to 100,000 $pm^2$ and the cross-section of the individual metal strands having a flat portion and an arcuate portion. The metal and polymer may be selected so that the composite is capable of being thermoformed without loss of electrical conductivity or transparency.

U.S. Pat. No. 5,137,782 to Adriaensen et al discloses a granular composite obtained by chopping a composite strand containing metal fibers, the fibers being embedded as bundles in a plastic and is to be used for the shaping of plastic articles. The metal fibers comprise hardened material that has been derived from an austenitic ferric alloy in which the austenite has been covered into martensite for at least 75 volume percent.

U.S. Pat. No. 5,165,985 to Wiste et al discloses a method of making a flexible transparent film providing electrostatic shielding by applying a plurality of thin conductive slivers to a sheet having a dimensionally stable layer and a thermoplastic layer. The slivers form a two dimensional conductive network.

U.S. Pat. No. 5,226,210 to Koskenmaki et al discloses a metal/polymer composite comprising a polymeric substrate and a sintered mat of randomly-oriented metal fibers embedded therein, the fibers having a substantially circular cross-section and a diameter of about 10 to 200 Nm. The polymeric substrate is typically a thin, flexible sheet-like material having a pair of planar surfaces. The polymeric substrate is preferably thermoformable. If thermoformability is desired the metal will have a melting point of less than the thermoforming temperature of the polymeric substrate. The thermoformable metal/polymer composite of the present invention may be stretched to at least 20%, and often can be stretched at least 200% of its original dimensions, at least in certain regions, without loss of electrical continuity or EMI shielding properties. The present invention also provides a method of making a metal/polymer composite and a sintered mat of randomly-oriented metal fibers.

Although the aforementioned references have contributed to the art, the use of a plurality of thin conductive slivers to form a two dimensional conductive network has provided a substantial improvement to the problems referred to above.

The plurality of thin conductive slivers is formed through a cladding and drawing process wherein metallic wire is clad and drawn to reduce the diameter of the wire. A plurality of the drawn metallic wires are clad and drawn to further decrease the diameter. The cladding and drawing process is continued until each of the plurality of conductive slivers obtains the proper diameter. Typically, each of the plurality of thin conductive slivers has a diameter of 4 microns.

It is therefore a primary object of the present invention to further improve the method of making a multiple diameter metallic tow material having major diameter fibers and minor diameter fibers.

Another object of this invention is to provide an improved method of making multiple diameter metallic tow material having major diameter fibers and minor diameter fibers with the minor diameter fibers having a diameter previously unobtainable in the prior art on a commercial basis.

Another object of this invention is to provide an improved method of making multiple diameter metallic tow material having major diameter fibers and minor diameter fibers capable of being severed into uniform length to provide slivers of metallic wires having major and minor diameters.

Another object of this invention is to provide an improved method of making multiple diameter metallic tow material having major diameter fibers and minor diameter fibers capable of being severed into uniform length to provide slivers of metallic wires for making a composite material comprising the slivers of metallic fiber and a polymeric material.

Another object of this invention is to provide an improved method of making multiple diameter metallic tow material having major diameter fibers and minor diameter fibers capable of being severed into uniform length to provide slivers of metallic wires for encapsulation within polymeric material for providing an electrically conductive metallic layer therein.

Another object of this invention is to provide an improved method of making multiple diameter metallic tow material having major diameter fibers and minor diameter fibers capable of being severed into uniform length to provide slivers of metallic wires for encapsulation within polymeric material to provide an electromagnetic interference resistant layer.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to the method of making a fiber tow having plural diameter metallic wires. A metallic wire is clad with a cladding material to provide a first cladding. The first cladding is drawn for reducing the diameter thereof to provide a first drawn cladding. The first drawn cladding is separated into a primary portion and a secondary portion. The secondary portion of the first drawn cladding is drawn for further reducing the outer diameter thereof. A plurality of the primary and the secondary portions of the first drawn claddings is clad to provide a second cladding. The second cladding is drawn for reducing the diameter thereof to provide a second drawn cladding. A plurality of the second drawn claddings is clad with a cladding material to provide a third cladding. The third cladding is drawn for reducing the diameter thereof. The third drawn cladding comprises the plurality of primary portions containing metallic wire having a major diameter and the plurality of secondary portions containing metallic wire having a minor diameter. The cladding material is removed to provide a fiber tow comprising metallic wires having the major diameter and metallic fibers having the minor diameter.

In a more specific embodiment, the process includes the step of sizing the diameter of the first cladding to provide an initial outer diameter and annealing the first cladding. Preferably, the step of drawing the cladding includes successively drawing and annealing the cladding for reducing the outer diameter thereof. The plurality of the primary and the secondary portions of the first drawn claddings are uniformly distributed within the second cladding. The cladding material may be removed by subjecting the third cladding to an acid for dissolving the cladding material. In the alternative, the cladding material may be removed by an electrolysis process or the like.

The fiber tow may be severed into uniform length to provide slivers of metallic wires having the major diameter and slivers of metallic wires having the minor diameter. The slivers of metallic wires may be dispersed into a uniformly distributed layer and encapsulated within polymeric material.

In one embodiment of the invention, the slivers of metallic wires are laminated between two sheets of polymeric material. When it is desirable for the polymeric material to be transparent, the quantity of the slivers of metallic wires is selected to be of a quantity sufficient to provide a conductive layer while being substantially transparent to visible electromagnetic radiation.

The invention is also incorporated into a composite material, comprising a mixture of a plurality of major diameter metallic fibers and a plurality of minor diameter metallic fibers. Encapsulating means encapsulates the major and minor diameter metallic fibers into a two dimensional conductive layer within a polymeric material.

The invention is also incorporated into an electromagnetic interference resistant layer, comprising a mixture of a plurality of major diameter metallic fibers and a plurality of minor diameter metallic fibers encapsulated within a polymeric material into a two dimensional conductive layer.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated that the conception and the specific embodiments disclosed may be readily utilized as a basis for modifying or designing other structures for carrying out the same purposes of the present invention. It also should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 3 is a diagram of the continued drawing process of the first cladding;

FIG. 3A is a cross-sectional view of a primary portion of the first cladding after passing through a fourth wire draw in FIG. 3;

FIG. 3B is a cross-sectional view of a secondary portion of the first cladding after passing through a fifth wire draw in FIG. 3;

FIG. 4 is a diagram of the process of preparing a second cladding of a plurality of first claddings for a drawing process;

FIG. 4A is a cross-sectional view of the plurality of first claddings after passing through a collecting die of FIG. 4;

FIG. 4B is a cross-sectional view of the plurality of first claddings of FIG. 4A in a second cladding;

FIG. 4C is a cross-sectional view of a second cladding of FIG. 4B after passing through the rotating die in FIG. 4;

FIG. 5 is a diagram of the drawing and annealing process of the second. cladding;

FIG. 5A is a cross-sectional view of the second cladding after passing through a first wire draw of FIG. 5;

FIG. 5B is a cross-sectional view of the second cladding after passing through a second wire draw of FIG. 5;

FIG. 5C is a cross-sectional view of the second cladding after passing through a third wire draw of FIG. 5;

FIG. 5D is a cross-sectional view of the second cladding after passing through a fourth wire draw of FIG. 5;

FIG. 6 is a diagram of the process of preparing a third cladding of a plurality of second claddings for a drawing process;

FIG. 6A is a cross-sectional view of the plurality of second claddings after passing through a collecting die of FIG. 6;

FIG. 6B is a cross-sectional view of the plurality of second claddings of FIG. 6A in a third cladding;

FIG. 6C is a cross-sectional view of a third cladding of FIG. 4B after passing through the rotating die in FIG. 6;

Similar reference characters refer to similar parts throughout the several Figures of the drawings.

DETAILED DISCUSSION

The present invention related to the method of making a fiber tow having plural diameter metallic wires from a metallic wire 10 through the use of a first, second and third cladding 11–13.

Figures 1, 1A, 1B, 1C, 1D, 2, 2A, 2B, 2C:
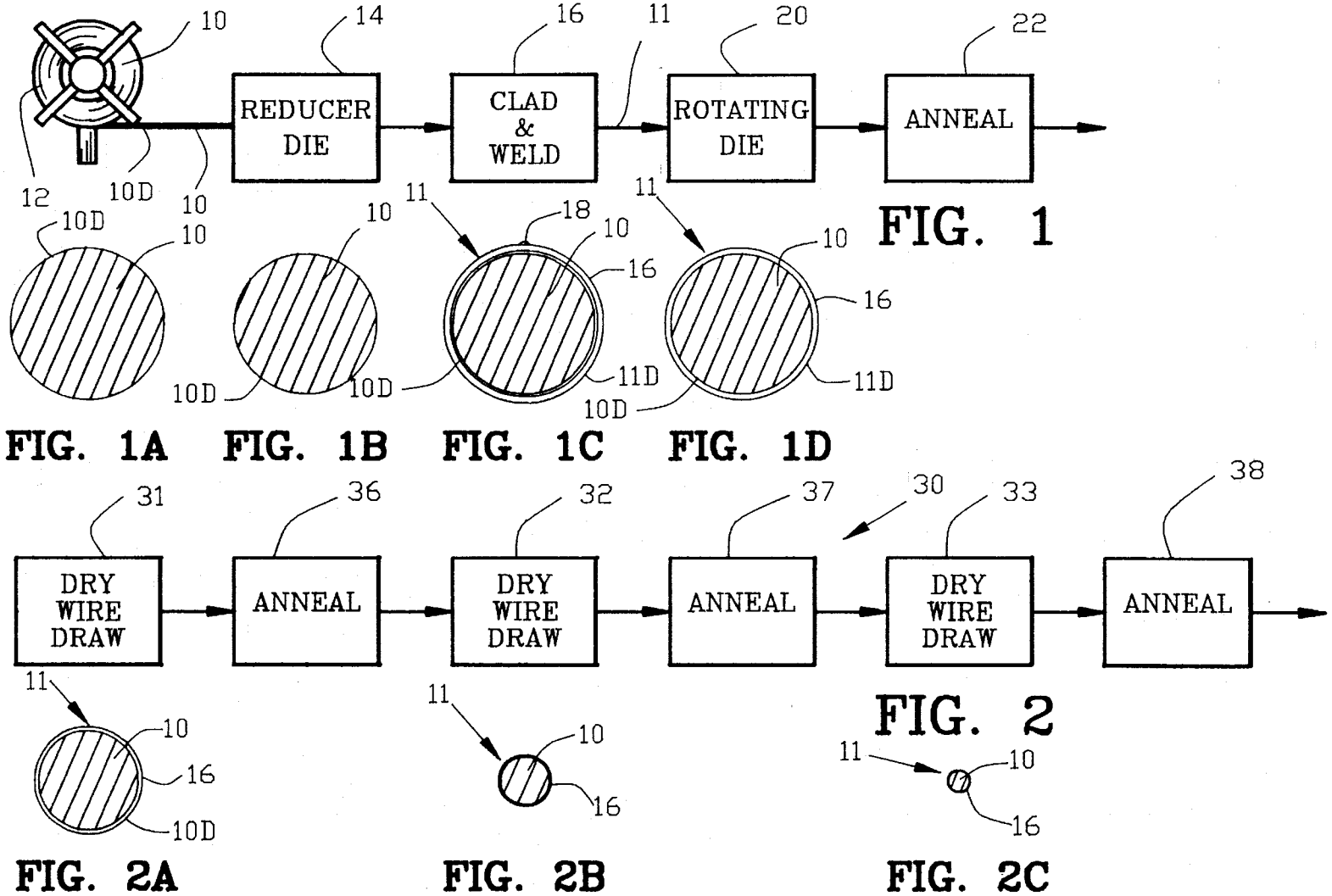
FIG. 1 is a diagram of the process of preparing a first cladding of a metallic wire for a drawing process.
FIG. 1A is a cross-sectional view of the metallic wire on the spool of FIG. 1.
FIG. 1B is a cross-sectional view of the metallic wire after passing through the reducer die in FIG. 1.
FIG. 1C is a cross-sectional view of the metallic wire of FIG. 1B in a first cladding.
FIG. 1D is a cross-sectional view of a first cladding of FIG. 1C after passing through the rotating die in FIG. 1.
FIG. 2 is a diagram of the drawing and annealing process of the first cladding.
FIG. 2A is a cross-sectional view of the first cladding after passing through a first wire draw of FIG. 2.
FIG. 2B is a cross-sectional view of the first cladding after passing through a second wire draw of FIG. 2.
FIG. 2C is a cross-sectional view of the first cladding after passing through a third wire draw of FIG. 2.

FIG. 1 is a diagram of the process of preparing a metallic wire 10 for a drawing process. The metallic wire 10 is selected to be resistant to a removal process such a being resistant to a selected acid or as being resistant to a selected electrolysis process as will be described in greater detail hereinafter.

FIG. 1A is a cross-sectional view of the metallic wire 10 on a spool 12 in FIG. 1 The metallic wire 10 is withdraw from the spool 12 into a reducer die 14 for sizing the outer diameter 10D to the metallic wire 10.

FIG. 1B is a cross-sectional view of tile metallic wire 10 after passing through the reducer die 14 in FIG. 1. The reducer die 14 eliminates inconsistences in the outer diameter 10D of the metallic wire 10 to provide a uniform outer diameter 10D to the metallic wire 10. The reducer die 14 also straightens the metallic wire 10 and removes any latent curvature caused by the storage of the metallic wire 10 on a storage spool.

The metallic wire 10 is clad with a cladding material 16 to provide the first cladding 11. The cladding material 16 is selected to be removable in a removal process such as being soluble in a selected acid or as being removable in a selected electrolysis process as will be described in greater detail hereinafter. Preferably, the cladding material 16 is a strip of material that is bent to circumscribe the outer diameter 10D of the metallic wire 10.

FIG. 1C is a cross-sectional view of the metallic wire 10 of FIG. 1B in the first cladding 11. Opposed ends of the cladding material 16 are continuously welded at 18 to secure the cladding material 16 to the metallic wire 10.

After the cladding material 16 is secured to the metallic wire 10, the first cladding 11 is passed through a rotating die 20. The rotating die 20 sizes the outer diameter 11D of the first cladding 11 to deform the cladding 11 into tight engagement with the metallic wire 10.

FIG. 1D is a cross-sectional view of the first cladding 11 after passing through the rotating die 20. The rotating die 20 sizes the outer diameter 11D of the first cladding 11 and eliminates any irregularities caused by the welding process to provide a uniform initial outer diameter 11D of the first cladding 11. The outer diameter 11D of the first cladding 11 is reduced to tightly engage the metallic wire 10.

The first cladding 11 is annealed by an annealing oven 22. Preferably, the first cladding 11 is continuously passed thorough the annealing oven 22 having an inert atmosphere.

Although the process of the present invention may be used with a variety of material and conditions, an example of the parameters of a specific process is set forth in TABLE I.

TABLE I

| FIRST CLAD PREPARATION | | |
|---|---|---|
| Metallic wire | Material | Type 304 Stainless Steel |
| | Initial Diameter | 0.265 inches |
| Cladding | Material | Low Carbon Steel |
| | Width | 0.875 inches |
| | Thickness | 0.020 inches |
| Annealing Oven | Temperature | 1750° F. |
| | Atmosphere | Nitrogen |

FIG. 2 is a diagram of the drawing and annealing process 30 of the first cladding 11. Preferably, the drawing and annealing process 30 of the first cladding 11 includes the successive drawing and annealing of the first cladding 11 for reducing the outer diameter 11D. Specifically the drawing and annealing process 30 of the first cladding 11 includes a first through third wire draws 31–33 and a first, second and a third anneal 36–38.

FIGS. 2A–2C are cross-sectional views of the first cladding 11 after passing through the first through third wire draws 31–33, respectively, in FIG. 2.

FIG. 3 is a diagram of the continued drawing process 30A of the first cladding 11 including a fourth wire draw 34. After the first cladding 11 is drawn through the fourth wire draw 34 the first cladding 11 is separated into a primary portion 41 and a secondary portion 42. The secondary portion 42 of the first cladding 11, is subjected to a fifth wire draw 35 for further reducing the outer diameter 11D.

FIG. 3A is a cross-sectional view of the primary portion 41 of the first cladding 11 after passing through the fourth wire draw 34 in FIG. 3 whereas FIG. 3B is a cross-sectional view of the secondary portion 42 of the first cladding 11 after passing through the fifth wire draw 35 of FIG. 3. The first cladding 11 in the primary portion 41 defines a major diameter whereas the first cladding 11 in the secondary portion 42 defines a minor diameter. The minor diameter of the secondary portion 42 of the first cladding 11 has a substantially smaller cross-sectional area relative to the major diameter of the primary portion 41 of the first cladding 11.

Although the drawing and annealing process 30 of the first cladding 11 may incorporate a variety of material and conditions, an example of the parameters of a specific process is set forth in TABLE II. The outside diameters listed in TABLE II represent the outside diameters of multiple dies that the first cladding 11 is drawn through in the respective continuous drawing process.

TABLE II

FIRST CLAD DRAW AND ANNEAL

| Wire Draw No. | Initial Diameter in Inches | Final Diameter in Inches |
|---|---|---|
| First Wire Draw | 0.287 | 0.187 |
| Second Wire Draw | 0.187 | 0.091 |
| Third Wire Draw | 0.091 | 0.040 |
| Fourth Wire Draw | 0.040 | 0.0254 |
| Fifth Wire Draw | 0.0254 | 0.0126 |
| Anneal No. | Temperature | |
| First Anneal | 1750° F. | |
| Second Anneal | 1750° F. | |
| Third Anneal | 1750° F. | |

FIG. 4 is a diagram of the process of cladding a plurality of the primary portions 41 and the secondary portions 42 of the first drawn claddings 11 to provide the second cladding 12. A plurality of primary spools 51 containing the primary portion 41 of the first cladding 11 having the major diameter are alternately disposed with a plurality of secondary spools 52 containing the secondary portion 41 of the first cladding 11 having the major diameter on a support 54.

FIG. 4A is a cross-sectional view of the second cladding 12 after passing through a collecting die 56 in FIG. 4. The plurality of primary spools 51 are alternately disposed with the plurality of secondary spools 52 to insure that the secondary portions 42 are uniformly distributed within the primary portions 41 within the second cladding 12. The collecting die 56 maintains the secondary portions 42 in uniform distribution within the primary portions 41.

Optionally, the collecting die 56 may twist the primary and secondary portions 41 and 42 in a partial rotation. A partial rotation insures that the primary and secondary portions 41 and 42 are maintained in a uniform distribution within the second cladding 12 during the drawing and annealing process.

The plurality of primary and secondary portions 41 and 42 of the first claddings 11 are clad with the cladding material 16 to provide the second cladding 12. The cladding material 16 is applied to the plurality of primary and secondary portions 41 and 42 of the first claddings 11 and welded at 18 in a manner similar to FIG. 1.

FIG. 4B is a cross-sectional view of the second cladding 12 with the cladding material 16 being continuously welded at 18 to secure the cladding material 16.

FIG. 4C is a cross-sectional view of the second cladding 12 after passing through a rotating die 60. The rotating die 60 sizes the outer diameter 12D of the second cladding 12 and eliminates any irregularities caused by the welding process. The second cladding 12 is annealed by continuously passing the second cladding 12 thorough an annealing oven 62 having an inert atmosphere.

Although the process of the present invention may be used with a variety of material and conditions, an example of the parameters of a specific process is set forth in TABLE III.

TABLE III

SECOND CLAD PREPARATION

| | | |
|---|---|---|
| Primary Portion | Initial Diameter | 0.0254 inches |
| Secondary Portion | Initial Diameter | 0.0126 inches |
| Partial Rotation (Optional) | Twist | ¼ to ½ turn |
| Cladding | Material | Low Carbon Steel |
| | Width | 0.875 inches |
| | Thickness | 0.020 inches |
| Annealing Oven | Temperature | 1750° F. |
| | Atmosphere | Nitrogen |

FIG. 5 is a diagram of the successive drawing and annealing process 70 of the second cladding 12 for reducing the outer diameter 11D. Specifically the drawing and annealing process 70 of the second cladding 12 includes a first through fourth wire draws 71–74 and a first and a second anneal 76–77.

FIGS. 5A–5D are cross-sectional views of the second cladding 12 after passing through the first through fourth wire draws 71–74, respectively, in FIG. 5.

Although the drawing and annealing process 70 of the second cladding 12 may incorporate a variety of materials and conditions, an example of the parameters of a specific process is set forth in TABLE IV. The outside diameters listed in TABLE IV represent the outside diameters of multiple dies that the second cladding 12 is drawn through in the respective continuous drawing process.

TABLE IV

SECOND CLAD DRAW AND ANNEAL

| Wire Draw No. | Initial Diameter in Inches | Final Diameter in Inches |
|---|---|---|
| First Wire Draw | 0.257 | 0.144 |
| Second Wire Draw | 0.144 | 0.064 |
| Third Wire Draw | 0.064 | 0.040 |
| Fourth Wire Draw | 0.040 | 0.0254 |
| Anneal No. | Temperature | |
| First Anneal | 1750° F. | |
| Second Anneal | 1750° F. | |
| Third Anneal | 1750° F. | |

FIG. 6 is a diagram of the process of cladding a plurality of the second claddings 12 to provide the third cladding 13. A plurality of spools 81 containing the second cladding 12 are disposed on a support 84.

FIG. 6A is a cross-sectional view of the third cladding 13 after passing through a collecting die 86 in FIG. 6. The plurality of second claddings 12 are collected to insure that the plurality of second claddings 12 maintain a uniform distribution within the third cladding 13 during the drawing and annealing process. Optionally, the collecting die 86 may twist the plurality of second claddings 12 to further insure that the plurality of second claddings 12 maintain a uniform distribution within the third cladding 13 during the drawing and annealing process The plurality of second claddings 12 are clad with the cladding material 16 to provide the third cladding 13. The cladding material 16 is applied to the plurality of second claddings 12 and welded at 18 in a manner similar to FIG. 1.

FIG. 6B is a cross-sectional view of the third cladding 13 with the cladding material 16 being continuously welded at 18 to secure the cladding material 16.

FIG. 6C is a cross-sectional view of the third cladding 13 after passing through a rotating die 90. The rotating die 90 sizes the outer diameter 13D of the third cladding 13 and eliminates any irregularities caused by the welding process. The third cladding 13 is annealed by continuously passing the third cladding 13 thorough an annealing oven 92 having an inert atmosphere.

Although the process of the present invention may be used with a variety of materials and conditions, an example of the parameters of a specific process is set forth in TABLE V.

TABLE V

| THIRD CLAD PREPARATION | | |
|---|---|---|
| Second Cladding | Initial Diameter | 0.0254 inches |
| Partial Rotation (Optional) | Twist | ¼ to ½ turn |
| Cladding | Material | Low Carbon Steel |
| | Width | 0.975 inches |
| | Thickness | 0.020 inches |
| Annealing Oven | Temperature | 1750° F. |
| | Atmosphere | Nitrogen |

Figures 7, 7A, 7B, 7C, 7D, 8, 9:
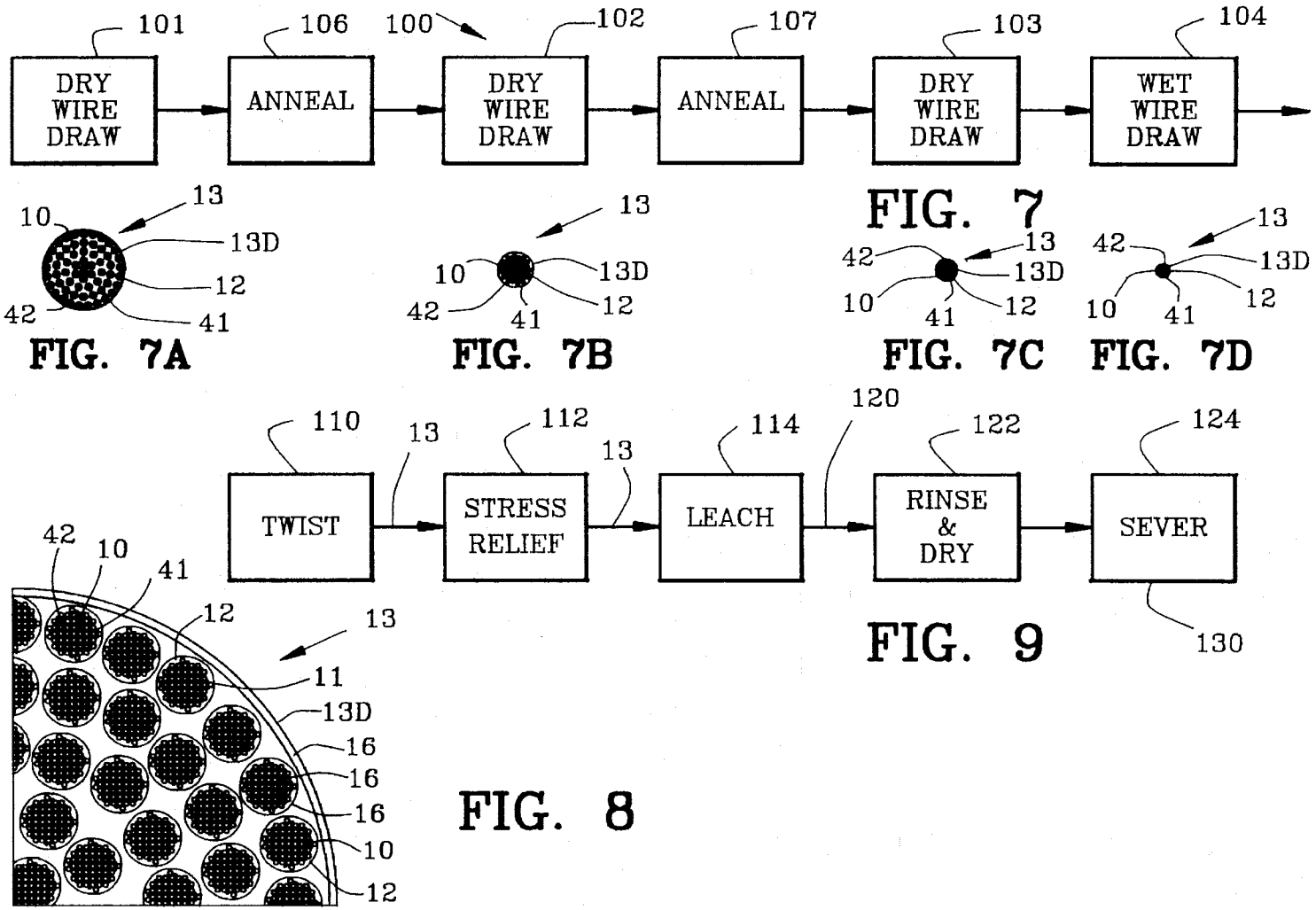
FIG. 7 is a diagram of the drawing and annealing process of the third cladding.
FIG. 7A is a cross-sectional view of the third cladding after passing through a first wire draw of FIG. 7.
FIG. 7B is a cross-sectional view of the third cladding after passing through a second wire draw of FIG. 7.
FIG. 7C is a cross-sectional view of the third cladding after passing through a third wire draw of FIG. 7.
FIG. 7D is a cross-sectional view of the third cladding after passing through a fourth wire draw of FIG. 7.
FIG. 8 is an enlarged partial cross-sectional view of the third cladding after the fourth drawing of FIG. 7.
FIG. 9 is a diagram of the processing of third cladding to provide a fiber tow having plural diameter metallic wires.

FIG. 7 is a diagram of the successive drawing and annealing process 100 of the third cladding 13 for reducing the outer diameter 13D. Specifically the drawing and annealing process 100 of the third cladding 13 includes a first through fourth wire draws 101–104 and a first and a second anneal 106–107.

FIGS. 7A–7D are cross-sectional views of the third cladding 13 after passing through the first through fourth wire draws 101–104, respectively, in FIG. 7.

Although the drawing and annealing process 100 of the third cladding 13 may incorporate a variety of materials and conditions, an example of the parameters of a specific process is set forth in TABLE VI. The outside diameters listed in TABLE VI represent the outside diameters of multiple dies that the third cladding 13 is drawn through in the respective continuous drawing process.

TABLE VI

| THIRD CLAD DRAW AND ANNEAL | | |
|---|---|---|
| Wire Draw No. | Initial Diameter in Inches | Final Diameter in Inches |
| First Wire Draw | 0.257 | 0.144 |
| Second Wire Draw | 0.144 | 0.064 |
| Third Wire Draw | 0.064 | 0.040 |
| Fourth Wire Draw | 0.040 | 0.020 |
| Anneal No. | Temperature | |
| First Anneal | 1750° F. | |
| Second Anneal | 1750° F. | |
| Third Anneal | 1750° F. | |

FIG. 8 is an enlarged partial cross-sectional view of the third cladding 13 after the fourth drawing of FIG. 7. An important aspect of the present invention resides in the capability of reducing the diameter 10D of the original metallic wire 10 to a fine wire fiber previously unobtainable in the prior art on a commercial basis.

In the example set forth in Tables I–VI, the major diameters of the primary portions 41 of the first cladding 11 are reduced to 4.0 micrometers whereas minor diameter of the secondary portions 42 of the first cladding 11 is reduced to 2.0 micrometers. The third cladding 13 comprises generally four parts of the major diameter wire fibers 41 to one part minor diameter wire fibers 42. Specifically, the third cladding 13 comprises eighty-three percent major diameter wire fibers 41 having a diameter of 4.0 micrometers and seventeen percent minor diameter wire fibers 42 having a diameter of 2.0 micrometers.

FIG. 9 is a diagram of the processing of the third cladding 13 to provide a fiber tow having metallic wire fibers. The third cladding 13 is twisted at 110 and is heated in an oven 112 to relieve stress in the metallic wire fibers. The third cladding 13 is subjected to a cladding removing process 114 to remove the cladding material 16 to produce a fiber tow 120 having metallic wire fibers. In this embodiment, the cladding removing process 114 is shown as a leaching process wherein the third cladding 13 is immersed into an acid for dissolving the acid soluble cladding material 16. In the alternative, the removing process 114 may include an electrolysis process for removing the cladding material 16. After completion of the removing process 114, the fiber tow 120 is subjected to a rinsing and drying process 122. The fiber tow 120 may be passed through a severing device 124 for breaking the fiber tow 120 into slivers 130 of a desired length.

In the alternative, the third cladding 13 may be twisted at 110 and heated in an oven 112 to relieve stress in the metallic wire fibers. The third cladding 13 may be passed through the severing device 124 for breaking the third cladding 13 into segment of a desired length. The severed segments of the third cladding 13 is subjected to the removing process 114 to remove the cladding material 16 to produce the slivers 130 of a desired length. After completion of the removing process 114, the slivers 130 are subjected to a rinsing and drying process 122.

Although the processing of the third cladding 13 may incorporate a variety of materials and conditions, an example of the parameters of a specific process is set forth in TABLE VII.

TABLE VII

| PROCESSING THIRD CLAD | | |
|---|---|---|
| Twist | Number of Twist | 0.5 turn per 1 inch |
| Stress Relief | Temperature | 750 degrees F. |
| | Time | 4 hours |
| Removing Clad | Acid | |

The fiber tow 120 comprises a plurality of major tow fibers 141 and a plurality of minor tow fibers 142. Each of the plurality of major tow fibers 141 has a major diameter whereas each of the plurality of minor tow fibers 142 has a minor diameter. The plurality of major tow fibers 141 is produced by the primary portion 41 whereas the plurality of minor tow fibers 142 is produced by the secondary portion 42. The ratio of primary portion 41 to the secondary portion 42 in the second cladding 12 determines the ratio of the quantity of major tow fibers 141 to the quantity of the minor tow fibers 142.

When the fiber tow 120 is severed by the severing device, the wire slivers 130 comprises a plurality of major wire slivers 151 and a plurality of minor wire slivers 152. Each of the plurality of major wire slivers 151 has a major diameter whereas each of the plurality of minor wire slivers 152 has a minor diameter. The ratio of primary portion 41 to the secondary portion 42 in the second cladding 12 determines the ratio of the quantity of major wire slivers 151 to the quantity of the minor wire slivers 152.

In the example illustrated in FIGS. 1–9, the diameter of the metallic wires of the primary portion 41 of the first cladding 11 was twice the diameter of the metallic wires of the secondary portion 42 of the first cladding 11. The ratio between the primary portion 41 to the secondary portion 42 in the second cladding 12 may be varied widely to produce fiber tow 120 or wire slivers 130 with a wide variety of relative diameters and volume ratios. The final diameter of the major tow fibers 141 was 4.0 microns whereas the final diameter of the minor tow fibers 142 was 2.0 microns.

The presence of the minor tow fibers 142 within the major tow fibers 141 provides several advantages over the prior art. Firstly, the overall weight of the fiber tow 120 is reduced without appreciable loss of the load strength of fiber tow 120. Secondly, the fiber tow 120 requires less material than the fiber tows of the prior art. Thirdly, the minor tow fibers 142 appear to bridge over or interconnect the major tow fibers 141 to provide a multi-dimensional continuous conductive grid 164. Fourthly, the presence of the minor tow fibers 142 within the major tow fibers 141 provides a superior electromagnetic interference resistant layer.

Previously, attempts to commercially produce metallic silver with a diameter below 3.0 microns have proven unsuccessful by the prior art. The inability to commercially produce high quality metallic sliver a diameter below 3.0 microns is the result of a low of breaking strength of the small diameter of the metallic wire fibers. The low breaking strength of the small diameter of the metallic wire fibers produces an increase in the number of broken wire fibers of the metallic fiber tow.

For example, in order to produce a metallic fiber tow with 1.0 micron wire fibers, the number of annealing and cladding operations should be increased by 20%–30%. This increase in the annealing and cladding operations will increase mutual diffusion between the cladding material and the metallic wire. Furthermore, the small diameter of the metallic wire fibers inhibits the separation of the individual wire fibers in the leaching process.

The prior art has attempted unsuccessfully to superimpose or to mix two metallic fiber tows with different wire fiber diameters to produce a mixture of multiple diameter metallic sliver. The super-imposing or mixing plural metallic fiber tows with different wire fiber diameters has been unsuccessful since a mechanical process will not provide a uniform mixture and distribution of the two metallic fiber tows. A uniform distribution of plural metallic fiber tows with different wire fiber diameters is critical for forming a conductive layer of wire fibers with the smaller wire fibers bridging over the larger wire fibers.

In the present invention, the method overcomes the problems of the prior art to provide a multiple diameter metallic tow material with major diameter metallic wire fibers of 4.0 microns and with minor diameter metallic wire fibers of less than 2.0 microns. Minor diameter metallic wire fibers of less than 1.0 micron are possible through the use of the method of the present invention.

In the method of the present invention, the minor diameter wire fibers are uniformly distributed with the major diameter wire fibers. The physical characteristics of the cladding, annealing and drawing process are primarily determined by the major diameter wire fibers. Since the physical characteristics are primarily determined by the major diameter wire fibers, the method of the present invention can produce minor diameter wire fibers of a diameter less than 1.0 microns without any significant increase in the number of broken wire fibers.

It should be appreciated that the fiber tow 120 and the wire slivers 130 have a variety of uses and may be incorporated into a multitude of products. One important area of application for the wire slivers 130 is in the production of filter for numerous filtering applications. Another important area of application for the wire slivers 130 is the creation of a continuous electrically conductive grid 164 for the suppression of electromagnetic interference (EMI) as discussed heretofore. The present invention provides a superior electrically conductive grid 164 due to the presence of the minor sliver fibers 151 which appear to interconnect with the major sliver fibers 152. The use of the wire slivers 130 or the fiber tow 120 as heretofore described in combination with a polymeric material is commonly referred to as a composite material.

Figure 10:
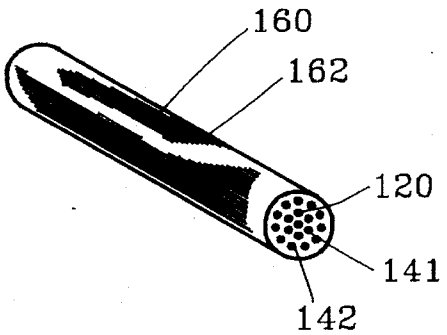
FIG. 10 is an isometric view of a first composite material comprising a mixture of a plurality of major diameter metallic fibers and a plurality of minor diameter metallic fibers encapsulated within a polymeric material.

FIG. 10 is an isometric view of a first example of a composite material 160 suitable for use in the present invention. The composite material 160 comprises a plug of the fiber tow 120 having the major tow fibers 141 and the minor tow fibers 142 encapsulated by a polymeric material 162. The composite 160 is suitable for use in mixing with other plastics in an injection molding process for creating injection molded parts having a continuous electrically conductive grid encapsulated therein for the suppression of electromagnetic interference (EMI). The injection molding of plastic cases for electronic devices is an example of a typical use of the present invention.

Figure 11:
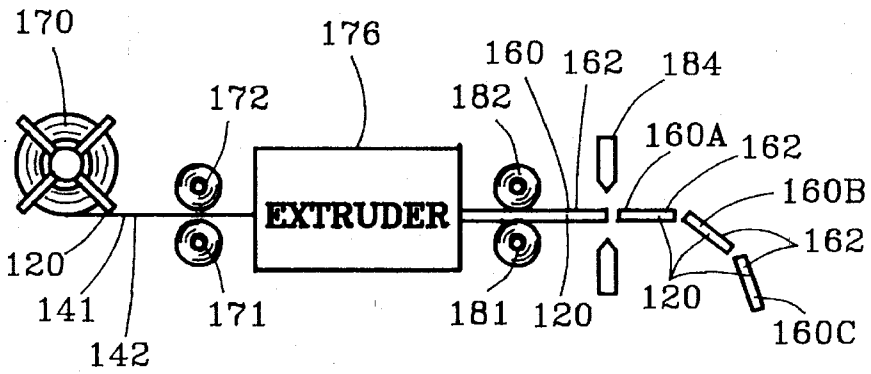
FIG. 11 is a diagram of a first process for making the composite material shown in FIG. 10.

FIG. 11 is a diagram of the process for creating the composite material 160 set forth in FIG. 10. The process includes moving the fiber tow 120 from a reel 170 through guide rollers 171 and 172 through an extruder 176. The extruder 176 encapsulates the fiber tow 120 with the polymeric material 162. The extruded composite material 160 is directed by guide rollers 181 and 182 to a cutter 184 for providing plugs 160A–160C.

Figure 12:
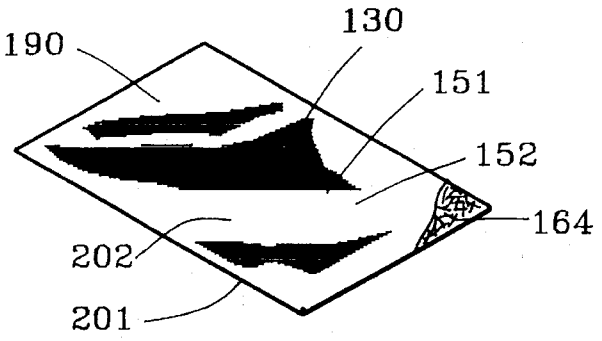
FIG. 12 is an isometric view of a second composite material comprising a mixture of a plurality of major diameter metallic fibers and a plurality of minor diameter metallic fibers encapsulated within a polymeric material.

FIG. 12 illustrates a second example of a composite material 190 which is suitable for using the multiple diameter wire slivers 130 of the present invention. In the embodiment, the major sliver fibers 151 and the minor silver fibers 152 are encapsulated between two sheets of polymeric material 201 and 202 in a laminating process or the like.

Figure 13:
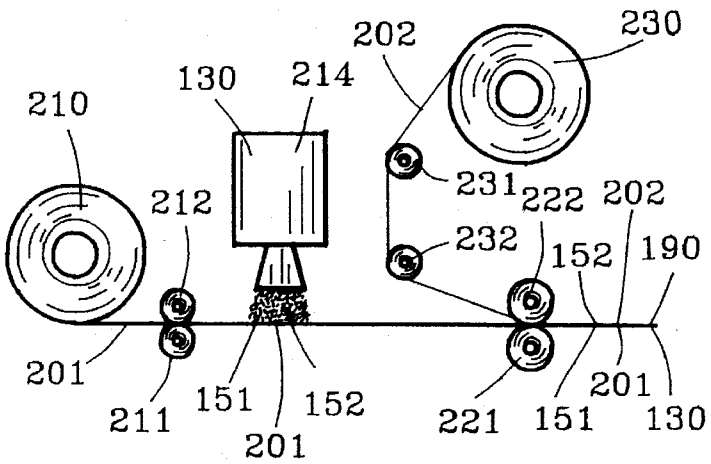
FIG. 13 is a diagram of a second process for making the composite material shown in FIG. 12.

FIG. 13 illustrates the process of making the composite 190 of FIG. 12. A roll 210 of the polymeric material 201 is directed by guide rollers 211 and 212 to an applicator 214 containing the wire slivers 130. The applicator 214 applies the wire slivers 130 to the sheet of the polymeric material 201, by an air blowing process. The major and minor wire slivers 151 and 152 are uniformly dispersed on the sheet of polymeric material 201. The sheet of polymeric material 201 is directed by guide rollers 221 and 222 for subsequent lamination with the sheet of polymeric material 202. A roll 230 of the polymeric material 202 is directed by guide rollers 231 and 232 to the rollers 221 and 222 for laminating the wire slivers 130 between the sheets of the polymeric materials 201 and 202. In the event the polymeric materials 201 and 202 is a transparent polymeric material, the mixture of the wire slivers 151 and 152 is of a quantity sufficient to provide a conductive layer or grid 164 while being substantially transparent to visible electromagnetic radiation. It should be appreciated by those skilled in the art that the fiber tow 120 and the slivers 130 may be encapsulated by numerous means as should be well known to those skilled in the art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A composite material, comprising:

a plurality of major and minor diameter metallic fibers with each of said plurality of major diameter metallic fibers having a greater diameter than each of said plurality of minor diameter metallic fibers;

a mixture of said plurality of major and minor diameter metallic fibers;

said plurality of major and minor diameter metallic fibers being substantially randomly oriented and substantially uniformly dispersed within said mixture; and a polymeric material encapsulating said mixture of said plurality of major and minor diameter metallic fibers.

2. A composite material, comprising:

a plurality of major and minor diameter metallic fibers with each of said plurality of major diameter metallic fibers having a greater diameter than each of said plurality of minor diameter metallic fibers;

a mixture of said plurality of major and minor diameter metallic fibers;

a polymeric material encapsulating said major and minor diameter metallic fibers; and said polymeric material including a lamination of said major and minor diameter metallic fibers between two sheets of polymeric material.

3. A composite material as set forth in claim 1, wherein said major and minor diameter metallic fibers are encapsulated with a polymeric material transparent to visible electromagnetic radiation; and said mixture of a plurality of major and minor diameter metallic fibers being of a quantity sufficient to provide an electrically conductive layer while being substantially transparent to visible electromagnetic radiation.

4. A composite material as set forth in claim 1, wherein said major and minor diameter metallic fibers are laminated with a polymeric material transparent to visible electromagnetic radiation; and said mixture of a plurality of major and minor diameter metallic fibers being of a quantity sufficient to provide an electrically conductive layer while being substantially transparent to visible electromagnetic radiation.

* * * * *

UNITED STATES PATENT AND TRADEMARK OFFICE

CERTIFICATE OF CORRECTION

PATENT NO. : 5,525,423

DATED : June 11, 1996

INVENTOR(S) : Liberman and Sobolevsky

It is certified that error appears in the above-identified patent and that said Letters Patent is hereby corrected as shown below:

On title page, item [54] and col. 1, lines 2-3

In the Title

Delete "Method for Making Multiple Diameter Metallic Tow" and insert therefore --Composite Material Comprising Encapsulated Multiple Diameter Metallic Fibers--.

Column 1, line 34, delete "EMIT" and insert therefore --EMI--.

Column 4, line 2, delete "Nm" and insert therefore --μm--.

Column 7, line 66, delete "tile" and insert therefore --the--.

Column 11, TABLE V, delete "0.975" and insert therefore --0.875--.

Column 13, line 30, delete "silver" and insert therefore --sliver--.

Column 14, line 46, delete "silver"and insert therefore --sliver--.

Signed and Sealed this

Twelfth Day of November, 1996

Bruce Lehman

*Attest:*

BRUCE LEHMAN

*Attesting Officer*

*Commissioner of Patents and Trademarks*